United States Patent [19]

Marshall et al.

[11] 4,085,991

[45] * Apr. 25, 1978

[54] ELECTRICAL SOCKET

[76] Inventors: Bruce H. Marshall, 2256 W. Arthur Ave., Chicago, Ill. 60645; Henry E. Blenner, 1515 E. Central Rd., Arlington Heights, Ill. 60005

[ * ] Notice: The portion of the term of this patent subsequent to Nov. 29, 1994, has been disclaimed.

[21] Appl. No.: 789,409

[22] Filed: Apr. 21, 1977

Related U.S. Application Data

[63] Continuation-in-part of Ser. No. 745,531, Nov. 29, 1976.

[51] Int. Cl.[2] ..... H01R 13/54

[52] U.S. Cl. ..... 339/75 P; 339/91 R

[58] Field of Search ..... 339/36, 37, 38, 39, 339/75 P, 82, 91 R

[56] References Cited

U.S. PATENT DOCUMENTS

| | | | |
|---|---|---|---|
| 2,732,531 | 1/1956 | Janowiec | 339/91 R |
| 2,844,805 | 7/1958 | Darrell | 339/37 |
| 2,888,662 | 5/1959 | Hammell | 339/258.5 |
| 3,182,280 | 5/1965 | Daut et al. | 339/38 |
| 3,192,499 | 6/1965 | West | 339/91 R |

*Primary Examiner*—Neil Abrams

*Attorney, Agent, or Firm*—Vogel, Dithmar, Stotland, Stratman & Levy

[57] ABSTRACT

An electrical socket has a body with a pair of spaced-apart channels for receiving the prongs of a male electrical plug. A pair of electrical contacts are mounted in said body respectively adjacent to said channels and in communication therewith. A pair of legs are pivotally mounted on the body and are movable between locking and unlocking positions. Each leg carries a finger which enters the aperture of the prong on the associated electrical plug when the legs are in the locking position thereof.

14 Claims, 12 Drawing Figures

FIG.1
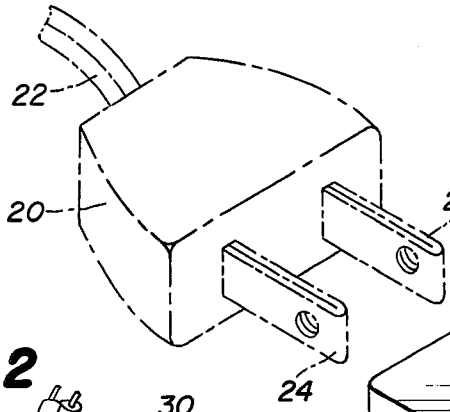
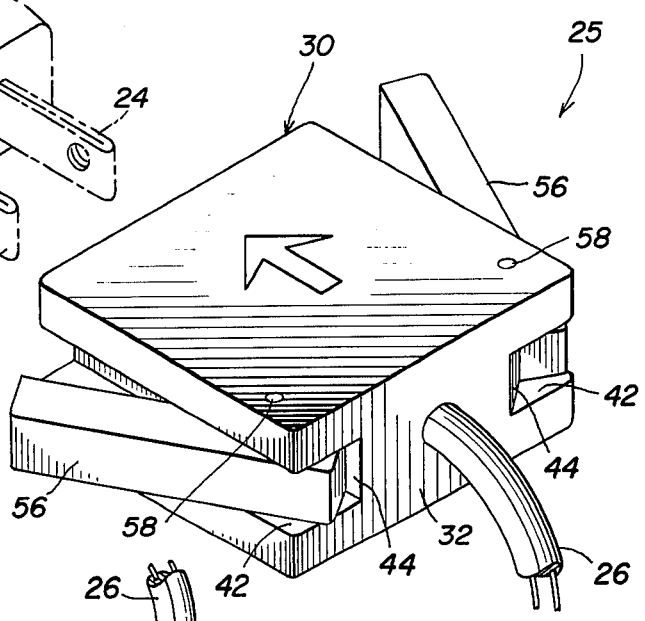
FIG.2
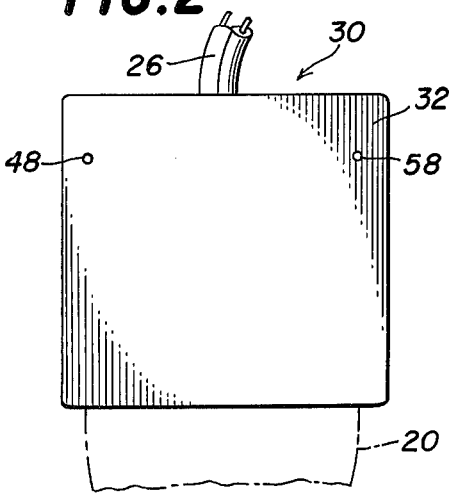
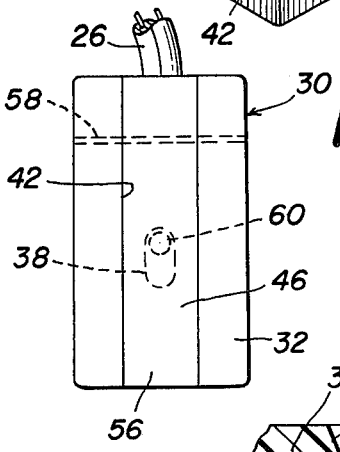
FIG. 3
FIG.4
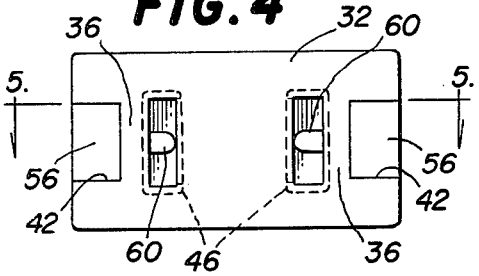
FIG.5
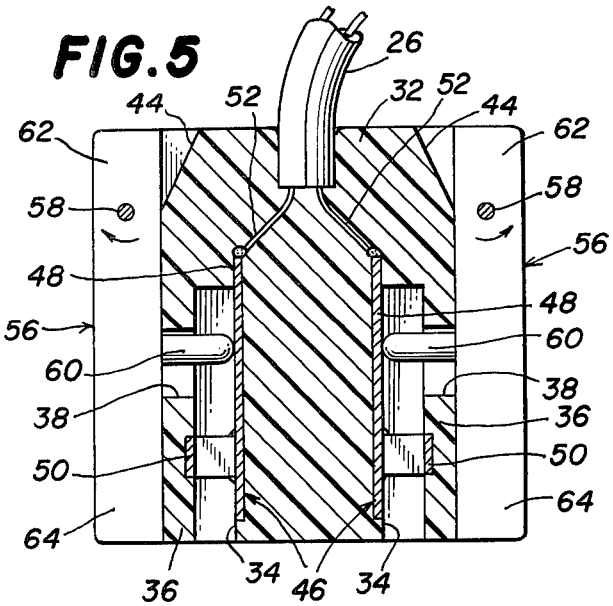
FIG.6
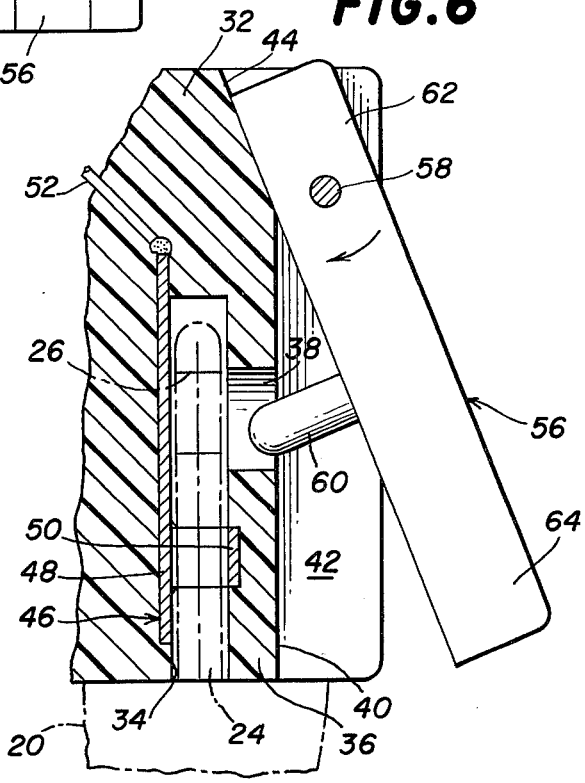

ELECTRICAL SOCKET

RELATED APPLICATION

This is a continuation-in-part application of application Ser. No. 745,531 filed Nov. 29, 1976 by Bruce H. Marshall and Henry E. Blenner, the applicants of the present application.

BACKGROUND OF THE INVENTION

This invention relates to an electrical socket that may be used at one end of an extension cord and to connect to a male electrical plug. The prior art dealing with a cap that is removably attached to an electrical plug is discussed in the aforementioned application.

An extension cord is used effectively to lengthen the electrical cord on an appliance or the like. These cords have a plug at one end and a socket at the other, which socket receives the plug on the appliance cord. Because currently available extension cords have a simple socket which frictionally holds the plug, there is a tendency for the plug unintentionally to become separated. Such separation by children is particularly hazardous, because the child could touch prongs which are still "hot".

SUMMARY OF THE INVENTION

It is an important object of the present invention to provide an electrical socket which can be removably latched onto an electrical plug to preclude unintentional separation of the two.

Another object is to provide an electrical socket which can be attached to an electrical plug and detached therefrom without the need of a key or other tool, but rather can be taken off by using one's fingers.

Another object is to provide an electrical socket which is unitary and does not have separable parts.

In summary, there is provided an electrical socket for interconnection with a male electrical plug having two spaced-apart prongs, respectively with apertures near the ends thereof, the electrical socket comprising a body having a pair of spaced-apart channels therein respectively to receive the prongs of the male electrical plug, a pair of electrical contacts in said body and respectively adjacent to said channels and in communication therewith, a pair of legs pivotally mounted on said body and movable between a locking position respectively alongside the channels and an unlocking position respectively away from the channels, and a pair of fingers respectively carried by the legs and located thereon to enter the apertures of the prongs when the legs are in the locking positions thereof and to be withdrawn from the apertures when the legs are in the unlocking positions thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purposes of facilitating an understanding of the invention, there is illustrated in the accompanying drawings, two preferred embodiments thereof from an inspection of which, when considered in connection with the following description, the invention, its construction, and operation, and many of its advantages can be readily understood and appreciated.

FIG. 1 is a perspective view, showing in phantom a male electrical plug being inserted into an electrical socket incorporating the features of the present invention;

FIG. 2 is a plan view of the electrical socket;

FIG. 3 is a side elevational view of the electrical socket;

FIG. 4 is an end elevational view of the electrical socket;

FIG. 5 is a view in vertical section, on an enlarged scale, taken along the line of 5—5 of FIG. 4;

FIG. 6 is a view on an enlarged scale of the right-hand portion of FIG. 5 with the prongs shown in phantom and with the locking leg shown in its unlocking position;

DESCRIPTION OF THE PREFERRED EMBODIMENTS

Figure 7:
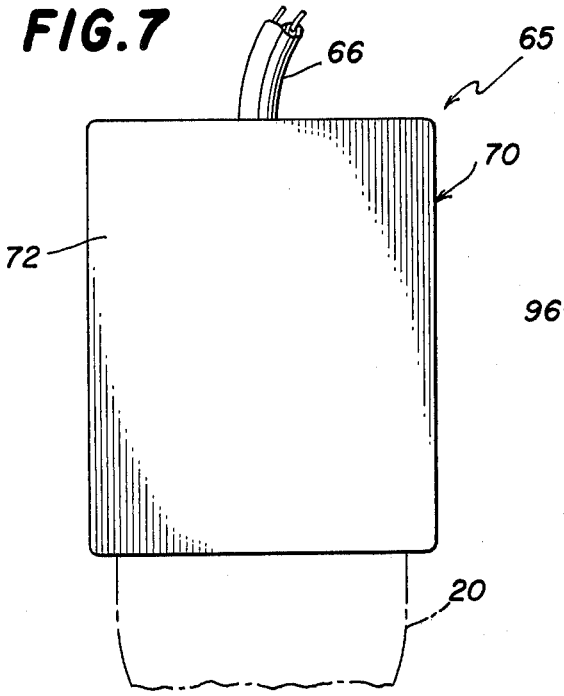
FIG. 7 is a plan view of a second embodiment of the present invention.
Figure 8:
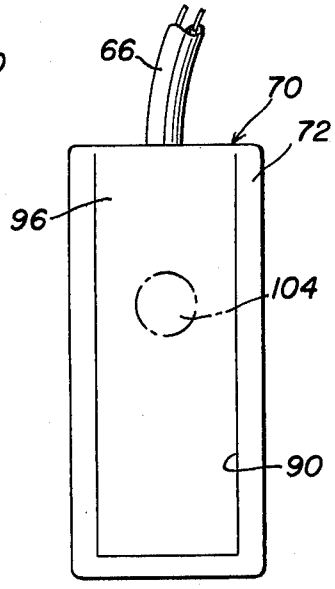
FIG. 8 is a side elevational view of the socket depicted in FIG. 7.
Figure 11:
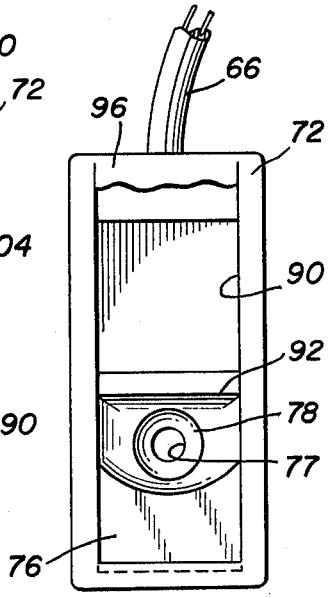
FIG. 11 is a view like FIG. 8 but with the locking leg having been removed.
Figure 9:
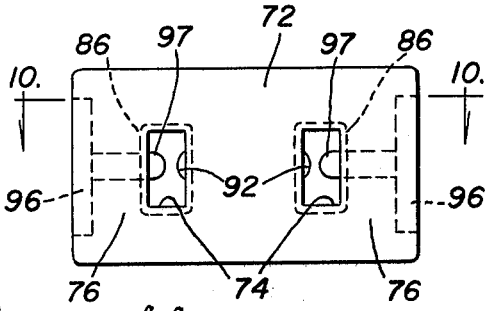
FIG. 9 is an end elevational view of the socket depicted in FIG. 7.
Figure 10:
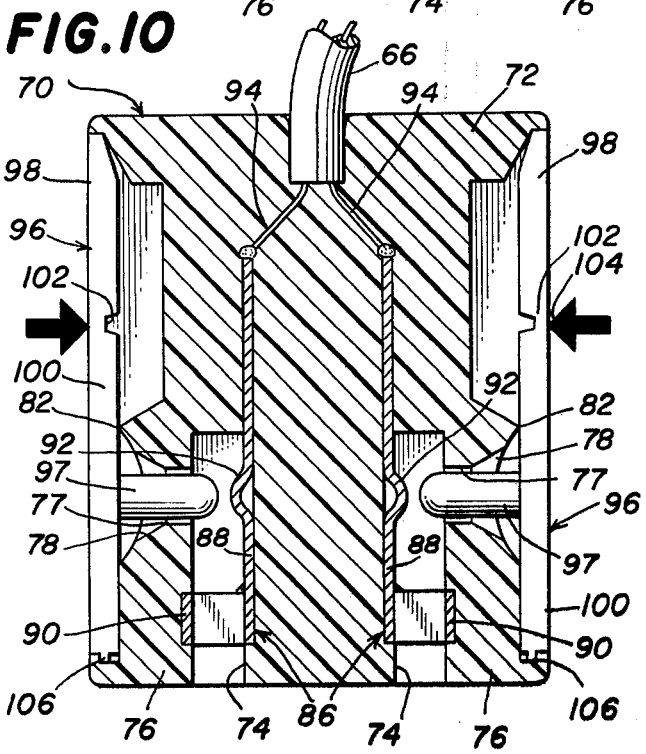
FIG. 10 is a view in vertical section on an enlarged scale taken along the line 10—10 of FIG. 9.

Turning now to the drawings, there is depicted in FIG. 1 a male electrical plug 20 attached to the end of a cord 22 and having the usual pair of spaced-apart prongs 24. As is standard, each prong 24 has a hole near its end. The cord 22 may be connected to an appliance or the like. In certain instances it may be desired to increase the effect of length of the appliance cord. To that end, there is provided an extension 25 having an electrical cord 26. At one end of the cord 26 is an electrical plug (not shown) adapted to be inserted into an electrical receptacle such as a wall outlet. On the other end of the extension 25 is an electrical socket 30, which socket 30 incorporates the features of the present invention.

The socket 30 includes a solid plastic body 32 generally rectangular in cross section. A pair of channels 34 in the body 32 are spaced apart the same distance as the prongs 24, and have lengths corresponding to the lengths of the prongs 24. A side of each channel 34 is defined by a wall 36, which has an opening 38 therein. In each side of the body 32 is a recess 40, whereby the body has an H-shaped cross-section. Each recess 40 is defined by side surfaces 42. At one end of each recess 40 is a slanted stop surface 44.

The socket 30 further comprises a pair of contacts 46, each of which contacts 46 includes an elongated strip portion 48 and a U-shaped portion 50 which are welded together. Each contact 46 is arranged such that the portion 48 is located adjacent to the associated channel 34 and is in communication therewith. The portion 50 has its bight also adjacent to the associated channel 34 and in communication therewith on the opposite side thereof. For convenience the drawing shows spaces between the prong 24 and the contact 46; in fact there is direct contact between the two preferably at the strip portion 48 and on each of the three legs of the U-shaped portion 50. The strip portion 48 is electrically connected to the cord 26 by means of conductors 52.

The socket 30 further comprises a pair of legs 56 pivotally mounted to the body 32 respectively by means of pins 58. Each leg 56 is movable between a locking position within the recess 40 and an unlocking position outside the recess, as shown in FIG. 6. Mounted on each leg 56 is an inwardly directed finger 60. The finger 60 in the embodiment shown, is integrally formed on its associated leg 56. The finger 60 is located such that when the associated leg 56 is pivoted toward the body 32, it enters the associated opening 38 and channel 34, and when pivoted away from the body 32, it is withdrawn from the associated channel 34 and opening 38. The parts are dimensioned such that when the prongs 24 or the plug 20 are inserted into the channels 34, and electrically engage the contact 46, the legs 56 can be pivoted to cause the fingers 60 to enter the holes in each prong 24.

The pin 58 divides each leg into a first section 62 and a second section 64. When the forefinger and thumb respectively engage the outer surfaces of the first sections 62 of the legs 56 and are pushed toward one another, the fingers 60 carried by the second section 64 are withdrawn, whereby the socket 30 is in an unlocking position and the plug 20 may be inserted therein. By then drawing together the sections 64, the fingers 60 are caused to enter the openings 38 and the holes in the prongs 24. In this condition, the plug 20 is removably latched to the extension cord 25. The side surfaces 42 frictionally engage the legs 56 and therefore constitute a retaining means to hold the legs 56 in their locking position. Without tools, the legs 56 may be unlocked by simply grasping the first sections 62, as described above, and causing the legs 56 to pivot outwardly until the sections 62 abut against the stop surfaces 44.

A second embodiment of the invention, depicted in FIGS. 7–12, is an extension 65 having a cord 66, a male plug (not shown) at one end and an electrical socket 70 at the other. The electrical socket 70 includes a solid, plastic body 72 generally rectangular in cross section and having a pair of channels 74 spaced apart the same distance as the prongs 24, the lengths of the channels corresponding to the lengths of the prongs 24. One side of each of the channels 74 is defined by a wall 76, which has an opening 77 therein communicating with a conically shaped guide 78. In each side of the body 72 is a recess 80. In each recess 80 is a projection with an edge defining a fulcrum 82. Formed at the bottom of each recess 80 is a lip which defines a keeper 84.

The socket 70 further comprises a pair of contacts 86, each of which includes an elongated strip portion 88 and a U-shaped portion 90 which are welded together. Each contact 86 is arranged such that the portion 88 is located adjacent to the associated channel 74 and is in communication therewith. The portion 90 has its bight also adjacent to the channel 74 and in communication therewith on the opposite side thereof. Although the drawings show spaces between the prong 24 and the contact 86, in fact there is direct contact between the two. Each strip portion 88 has formed therein a nib 92 projecting into the associated channel 74 and laterally aligned with the associated opening 77. The strip portion 88 is electrically connected to the cord 66 by means of conductors 94.

Figure 12:
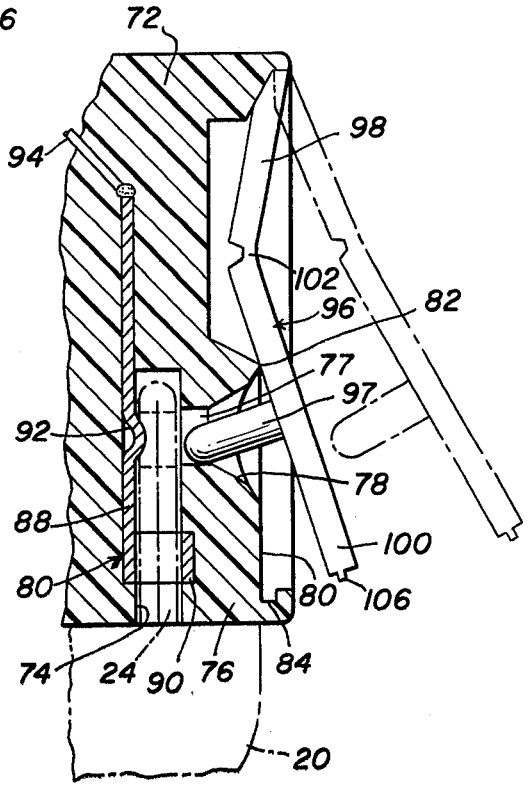
FIG. 12 is a view of the right-hand portion of FIG. 10 showing a prong in phantom and the locking leg in two stages of its unlocking position.

The socket 70 further comprises a pair of legs 96 integral with the body 72 and pivotally mounted thereon. These legs 96 are movable between a locking position within the recesses 80 respectively, and an unlocking position wherein these legs are pivoted outwardly, as shown in FIG. 12. On each leg 96 is an inwardly directed finger 97 which may be integrally formed thereon. Each finger 97 is located such that when the associated leg 96 is pivoted toward the body 72, the finger 97 is guided by means of the guide 78, through the opening 77 in facing relationship with the associated nib 92. When the legs 96 are pivoted away from each other, the fingers 97 are withdrawn from the channels 74 and the openings 77. The parts are dimensioned such that when the prongs 24 of the plug 20 are inserted into the channels 74, the fingers 97 will enter the holes in the prongs 24.

Each leg 96 is integral and has a first section 98 and a second section 100 joined by a hinge 102, which sections are dimensioned such that the fulcrum 82 is opposite the second section 100. The finger 97 is located on the second section 100 between the fulcrum and the free end of the leg 96. A lip 106 is provided on the free end of the leg 96. When the region of the leg 96 near the hinge 102 is pushed inwardly, the associated section 100 is pivoted about the fulcrum 82 causing the associated lip 106 to snap out of its keeper 84. This is the position represented by the leg 96 shown in solid line. Then the leg 96 may be grasped and pivoted further, to withdraw the finger 97 from the associated hole in the plug prong 24. Now the leg 96 is in its unlocking position as represented by the phantom line in FIG. 12. The plug 20 may then be inserted. By drawing together the sections 100, the fingers 97 are caused respectively to enter the openings 77 and the holes in the prongs 24 and the lips 106 snap into the keepers 84. In this condition, the plug 20 is removably latched to the extension cord 65. Without tools, the legs 96 may be unlocked by simply pushing on the hinges 102 in the manner described above.

What have been described, therefore, are two embodiments of an improved electrical socket, for an extension cord, for example, which socket can be attached to an electrical plug and is readily detachable without the use of a tool.

We claim:

1. An electrical socket for interconnection with a male electrical plug having two spaced-apart prongs, respectively with apertures near the ends thereof, said socket comprising a body having a pair of spaced-apart channels therein respectively to receive the prongs of the male electrical plug, said body further having therein a pair of outwardly facing, oppositely directed recesses, a pair of electrical contacts in said body and respectively adjacent to said channels and in communication therewith, a pair of legs pivotally mounted on said body and movable between a locking position respectively in said recesses and respectively alongside said channels and an unlocking position respectively out of said recesses and respectively away from said channels, and a pair of fingers respectively carried by said legs and located thereon respectively to enter the apertures of the prongs when the legs are in the locking positions thereof and to be withdrawn from the apertures when the legs are in the unlocking positions thereof.

2. The electrical socket set forth in claim 1, wherein each recess is U-shaped in cross section.

3. The electrical socket set forth in claim 1, wherein said body has a pair of separating walls respectively between said channels and said recesses, each of said walls having an opening therein through which the associated finger is movable.

4. The electrical socket set forth in claim 1, wherein said body has a pair of stop surfaces thereon to limit movement of said legs respectively away from said body.

5. The electrical socket of claim 1, wherein said legs are integral with said body.

6. The electrical socket set forth in claim 1, wherein each of said legs has hingedly connected first and second sections, one end of said first section being pivotally mounted to said body, said body having fulcrum means opposite a region on said second section, an associated finger being on said second section between said region and the free end thereof, whereby pressure of the thumb and forefinger respectively in the regions of said hinges respectively simultaneously pivots said second sections of said legs about said fulcrum means to withdraw said fingers from the apertures.

7. The electrical socket set forth in claim 1, wherein each of said legs is rigid and is pivotally mounted to said body at a point between the ends thereof, thereby defining first and second sections of said leg on each side of said point, said finger being located on said first section, said second sections respectively of said legs being simultaneously gripable respectively by the thumb and forefinger to be moved toward each other to place said legs in the unlocking positions thereof.

8. The electrical socket set forth in claim 1, wherein said legs are held in said body in the locking positions thereof by means of substantial frictional engagement between said legs and said body.

9. The electrical socket set forth in claim 1, wherein said body and said legs are formed of plastic.

10. The electrical socket of claim 1, further comprising a pair of retaining means for respectively holding said legs in the locking positions thereof.

11. The electrical socket set forth in claim 1, and further comprising a pair of retaining means respectively on the free ends of said legs.

12. The electrical socket set forth in claim 1, and further comprising a pair of pins respectively pivotally connecting said legs to said body.

13. The electrical socket set forth in claim 1, wherein each of said contacts includes a strip portion and a U-shaped portion electrically and mechanically interconnected.

14. The electrical socket set forth in claim 13, wherein each of said contacts further includes a nib on said strip portion which projects into the associated channel, said nib being respectively aligned with the associated finger in the locking position of the associated leg.

* * * * *